United States Patent [19]

Giladett

[11] 4,216,723

[45] Aug. 12, 1980

[54] BOMBLET FUZE

[75] Inventor: Leo V. Giladett, Santa Cruz, Calif.

[73] Assignee: The United States of America as represented by the Secretary of the Air Force, Washington, D.C.

[21] Appl. No.: 801,715

[22] Filed: May 31, 1977

Related U.S. Application Data

[63] Continuation-in-part of Ser. No. 538,840, Jan. 8, 1975, abandoned.

[51] Int. Cl.[2] ..... F42C 5/00

[52] U.S. Cl. ..... 102/223; 102/229

[58] Field of Search ..... 102/73, 76, 81, 81.2, 102/7.2, 223, 229

[56] References Cited

U.S. PATENT DOCUMENTS

| | | | |
|---|---|---|---|
| 2,985,105 | 5/1961 | Rabinow et al. | 102/81.2 |
| 3,613,595 | 11/1971 | Blomgren et al. | 102/81.2 |
| 3,678,859 | 7/1972 | Wesson et al. | 102/76 R |
| 3,802,344 | 4/1974 | Laepple | 102/7.2 |
| 3,842,743 | 10/1974 | Zittle | 102/81.2 |
| 3,973,501 | 8/1976 | Briggs | 102/76 R |

FOREIGN PATENT DOCUMENTS

| | | | |
|---|---|---|---|
| 2306572 | 8/1974 | Fed. Rep. of Germany | 102/76 |

*Primary Examiner*—Harold J. Tudor

*Attorney, Agent, or Firm*—Joseph E. Rusz; Jacob N. Erlich

[57] ABSTRACT

A miniature fuze for use with a bomblet munition having an arming and firing mechanism located adjacent one another within the fuze housing. The arming mechanism has no stored energy therein and relies upon a plurality of distinct operations to take place before cocking of the fuze begins. After cocking, the fuze is capable of being armed and can thereafter be detonated upon impact.

8 Claims, 8 Drawing Figures

FIG. 2
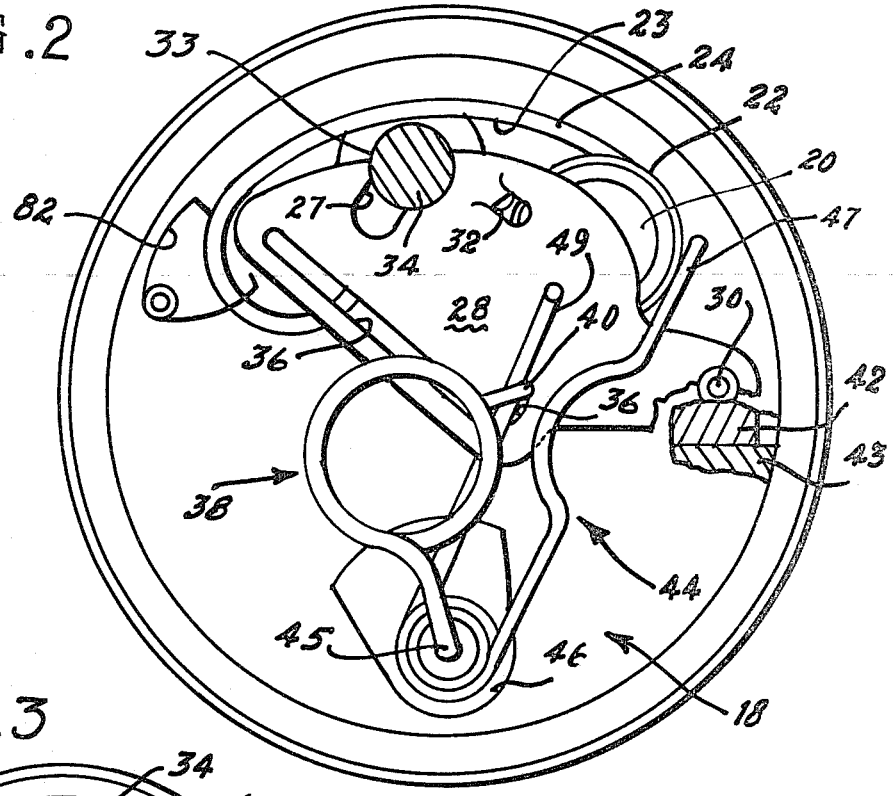
FIG. 3
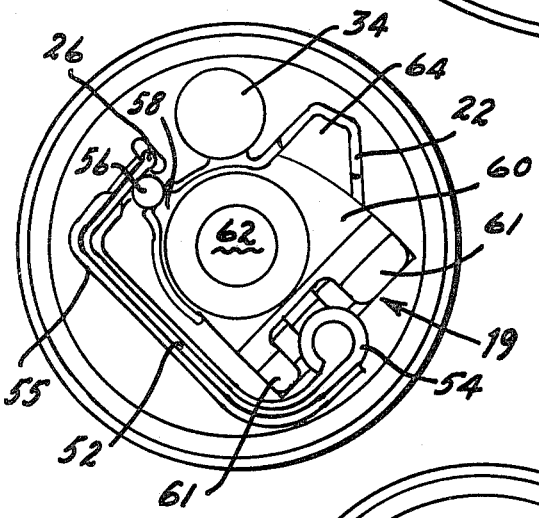
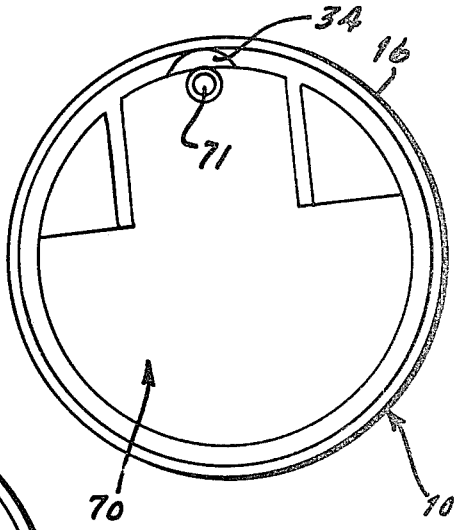
FIG. 5
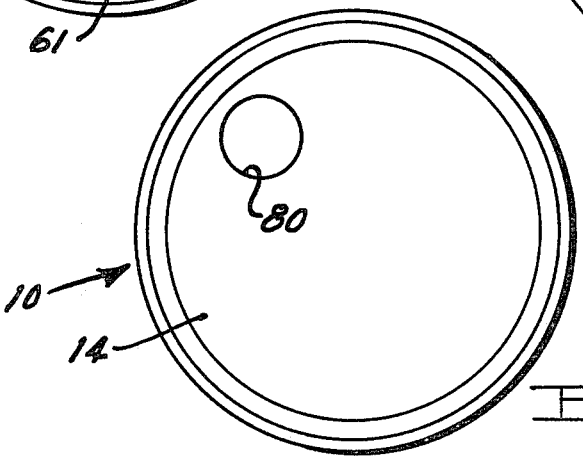
FIG. 8

BOMBLET FUZE

STATEMENT OF GOVERNMENT INTEREST

The invention described herein may be manufactured and used by or for the Government for governmental purposes without the payment of any royalty thereon.

This is a continuation-in-part of patent application Ser. No. 538,840 of Leo V. Giladett filed Jan. 8, 1975 and entitled Bomblet Fuze, now abandoned.

BACKGROUND OF THE INVENTION

This invention relates generally to fuzes for bomblets and, more particularly, to a fuze which is capable of being safely armed and yet provides for a highly reliable detonation of the bomblet.

A relatively new class of munition, the bomblet has been brought into large scale military use during the past 25 years. In general such devices are used in great numbers and require specialized types of fuzes, usually of miniature size and producible at low cost. A fuze is the mechanism for igniting and detonating the bursting charge of any munition, such as the bomblet, and performs this function either upon impact or at a certain time during flight. The purpose of safing and arming fuzes is to provide a safety to personnel during the handling and storage of fuzes while permitting placement of the munition containing the fuze in the desired position over the target area before the munition is armed. The munition is then exploded on the target by the initiation from the fuze upon impact thereof. Various ways have heretofore been employed for the prevention of pre-target detonation of these munitions during tactical deployment.

Certain safety and reliability requirements have been found to be difficult to implement in the small fuzes utilized in bomblets. These requirements include the incorporation therein of mechanisms designed to sense and respond to the last two conditions or circumstances associated with the launching and flight environment in such a manner that the munition offers a high degree of safety for transportation and handling, firing etc. prior to the sensing of these factors, but is enabled to operate properly after sensing a proper sequence and magnitude of events.

Another requirement which has been found to be difficult to implement is the restriction on the use of stored energy, that is compressed springs, in the safety and arming mechanisms. It is believed that no energy source of any kind should be present in the fuze which would tend to cause an uninitiated arming function to occur.

Existing fuzes of the type referred to hereinabove are typically caused to arm or render themselves ready to function explosively upon impact with the ground or other surface by means of sensing and utilizing the rotation imparted to the fuzed munition after release or launching from the vehicle in which it has been carried. The requirement to utilize munition rotation as a source of arming forces, imposes certain restrictions on the length of travel through the air and the velocity at which this occurs. Heretofore, the above problems have not been successfully overcome.

SUMMARY OF THE INVENTION

The instant invention provides a fuze for a bomblet which eliminates the problems set forth in detail hereinabove. This fuze is so designed as not to require munition rotation for arming, but utilizes other arming forces in such a manner as to afford improved safety and reliability of operation. This is accomplished without the imposition of restrictions or maintenance or any particular attitude of the fuzed munition relative to its passage through the air, or the position in which it strikes the ground, or any surface, to cause the explosive function to occur.

The instant invention sets forth a fuze which requires the initiation of two distinctive functions to occur before detonation of the munition can occur. Although this invention relies upon the operation of a pair of springs, the arming spring has little or no preload in the safe position and thereby eliminates any premature detonation of the munition. In addition, the other elements which make up the fuze of this invention are of extremely rugged construction and thereby eliminates the cause of failure due to inertial forces acting thereon.

It is therefore an object of this invention to provide a miniaturized fuze for use with a bomblet munition which incorporates therein two independent arming systems which must operate at a proper sequence to enable the fuze to function.

It is another object of this invention to provide a miniaturized fuze for use with a bomblet munition which will arm and fire the munition without the use of rotational forces thereon.

It is a further object of this invention to provide a miniaturized fuze for use with a bomblet munition which will arm and fire the associated munition under predetermined circumstances but does not require a specific attitude or orientation of the munition to do so.

It is still a further object of this invention to provide a miniaturized fuze for use with a bomblet munition in which no stored energy devices are utilized in the safing and arming functions of the fuze prior to the initial arming input.

It is still further an object of this invention to provide a miniaturized fuze which is economical to produce, extremely durable in construction, and which utilizes conventional, currently available components that lend themselves to standard mass producing manufacturing techniques.

For a better understanding of the present invention together with other and further objects thereof reference is made to the following description taken in conjunction with the accompanying drawing and its scope will be pointed out in the appended claims.

DESCRIPTION OF THE DRAWING

FIG. 2 is an enlarged plan view of the arming mechanism of the fuze of this invention in the safe or unarmed position taken along line 2—2 of FIG. 1 and shown partly in cross-section;

FIG. 3 is a reduced plan view of the firing mechanism of the fuze of this invention taken along line 3—3 of FIG. 1 and shown partly in cross-section;

FIG. 5 is a reduced plan view of the wind tab of the bomblet fuze of this invention;

FIG. 8 is a reduced bottom view of the bomblet fuze of this invention.

DETAILED DESCRIPTION OF THE PREFERRED EMBODIMENT

Figure 1:
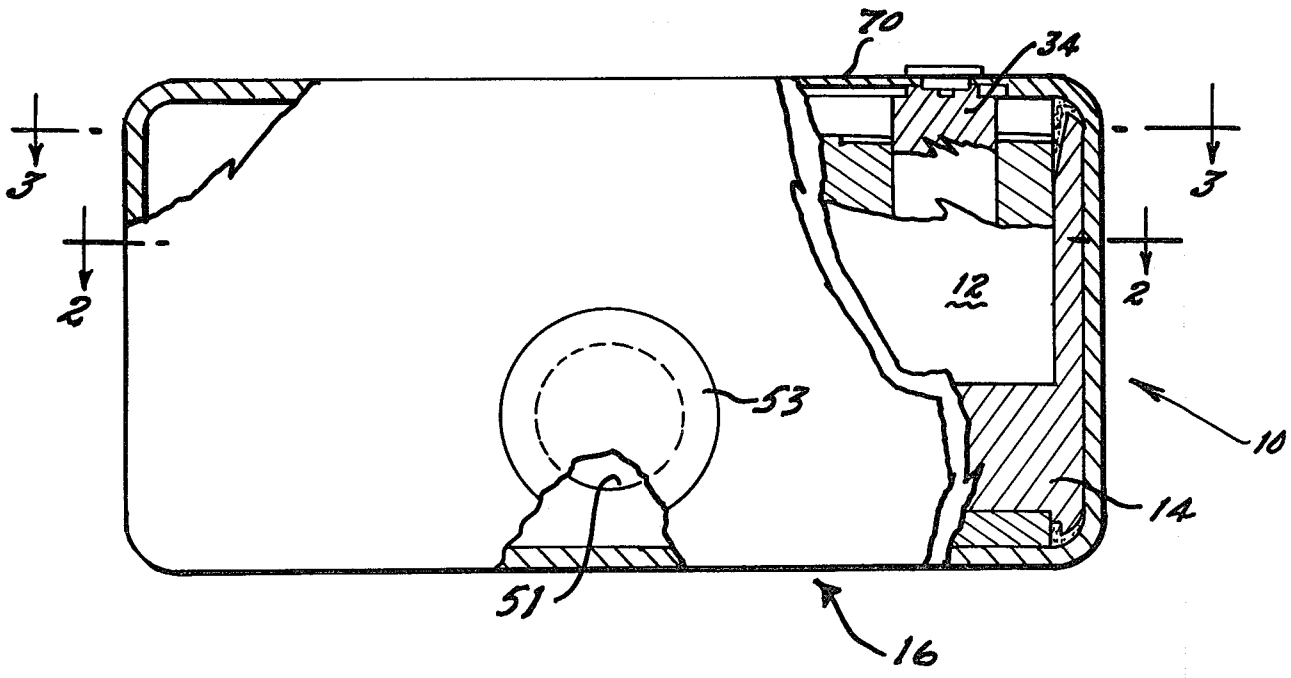
FIG. 1 is an enlarged side elevational view of the bomblet fuze of this invention shown partly in cross section.

Reference is now made to FIG. 1 of the drawing which best shows the external configuration of fuze 10 of this invention. Fuze 10 is made up of an upper body 12 and a lower body 14 forming a housing 16 which encompasses the main interior components making up fuze 10 of the instant invention. These interior components are in the form of an arming mechanism 18 and a firing mechanism 19 shown in FIGS. 2 and 3 of the drawing.

Reference will now be made to FIGS. 1 and 2 which show the workings of arming mechanism 18 located within lower body 12. Arming mechanism 18 is made up of a detonator 20 which is retained within a slider assembly 22. Slider assembly 22 is movable within an opening or slot 23 from the position shown in FIG. 2 along a curved channel 24 to its final position in alignment with the firing pin 26 (shown in FIG. 3) in a manner to be described in detail hereinbelow. Slider assembly 22 is meanwhile retained in the safe position as shown in FIG. 2 primarily by the presence of a lock plate 28 which is pivotally mounted within lower body 14 on a pin 30 fixedly secured within lower body 14. An indented tab 32 formed on locking plate 28 abuts slider assembly 22 in the safe or unarmed position.

Also retained within body 16 is a wind tab pin 34 held in position by a slot 27 within lock plate 28. Wind tab pin 34 can be removed only upward along its axis. To prevent this action the sides of slot 27 of lock plate 28 fit within a groove 33 in pin 34. Also located within lock plate 28 is a cam slot 36 whose function will be described hereinbelow.

Locking plate 28 is retained in the safe or unarmed position, shown in FIG. 2, by the presence of a cocking spring 38 having the working end 40 situated within cam slot 36, lock plate pivot pin 30 which is integral with lower body 14, and upper and lower bodies 12 and 14 respectively. As shown in FIG. 2, locking plate 28 is thereby restrained in all directions.

Figure 4:
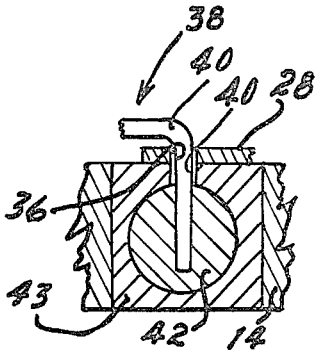
FIG. 4 is a cross-sectional view showing specifically the connection between the piston and cocking spring utilized with the instant invention.

Cocking spring 38 is restrained in position by a built-in preload. The working end 40 of cocking spring 38 as shown in FIG. 4 after passing through cam slot 36 in lock plate 28, passes through a slot 41 in lower body 14 and is fixedly secured within a piston 42. Piston 42 is slidably mounted within a cylindrical piston housing 43 located in lower body 14. Fuze 10, as shown in FIG. 1, features a hole 51 aligned with piston 42. Hole 51 is closed off from moisture and contaminants by any suitable sealing means such as foil seal 53. When gas pressure is applied to the exterior of fuze 10, it bursts foil seal 53 and impinges on piston 42. This pressure causes subsequent forward movement of piston 42 within housing 43 and thereby initiates the arming section by moving cocking spring 38 in the counter clockwise direction in a manner to be described in detail hereinbelow. Although pressure operated piston 42 is shown as a preferred actuating mechanism, any means capable of causing the movement of cocking spring 38 under the application of an external pressure is acceptable.

As shown in FIG. 2, the anchor end 45 of spring 38 terminates in a hole in lower body 14. Also making up the arming mechanism 18 of the fuze 10 of this invention is an arming spring 44 which has little or no preload in the safe position shown in FIG. 2. Spring 44 is positioned by an integral pivot boss 46 on lower body 14 and has an arm 47 engaging slider 22 and an arm 49 in contact with end 40 of cocking spring 38.

Reference is now made to FIGS. 1 and 3 which best show the firing mechanism 19 of the fuze 10 of this invention. Firing mechanism 19 is located above arming mechanism 18 and is made up of a firing pin 26 in the form of a bent wire spring 52 secured at one end 54 to upper body 12 and with the striker point or firing pin 26 being pointed downward. Firing mechanism 19 is so positioned within body 16 that it is located directly above and in operative alignment with the arming mechanism 18.

Firing pin 26 is retained in the cocked position by the presence of a sear ball 56. Although firing pin spring 52 attempts to cam ball 56 out of the way and allow spring 52 to move downward through opening 55, sear ball 56 is in turn blocked by the nose 58 of a lever 60 pivotally connected to body 12 at 61. Retained in the central portion of lever 60 is an inertia ball 62 which is utilized in the final detonation of fuze 10. Lever 60 is prevented from movement in the downward direction and held in the safe position by an integral foot 64 which has its lower end, during the safe position, in alignment with and at rest against slider assembly 22. It is therefore seen that slider assembly 22 in the safe position shown in FIG. 2 holds the firing mechanism 19 in the safe position.

A wind tab 70 best shown in FIG. 5 is attached to wind tab pin 34 and is retracted from housing 16 by means of aerodynamic forces in a manner to be described in detail hereinbelow. It is clear that in the safe or unarmed position (shown in FIG. 2 of the drawing) detonator 20, which is staked into slider assembly 22, is retained in this position by the wind tab pin 34 and the tab or ear 32 on lock plate 28. Both these elements 32 and 34 must be removed in order to free slider assembly 22 in a manner to be described hereinbelow.

It is to be noted that there is no stored energy in fuze 10 which would cause detonator 20 to inadvertently move to the armed position, that is, in alignment with firing pin 26, since cocking spring 38 although preloaded, is preloaded toward the safe position within cam slot 36 of locking plate 28 and opposes any initial movement thereof. In addition failure of any component within the system, including cocking spring 38 cannot cause arming to take place since there is no energy there which will cause the subsequent movement of locking plate 28. It is necessary to introduce an external pressure energy through piston 42 to cause the arming operation to take place in a manner to be described hereinbelow.

Figure 6:
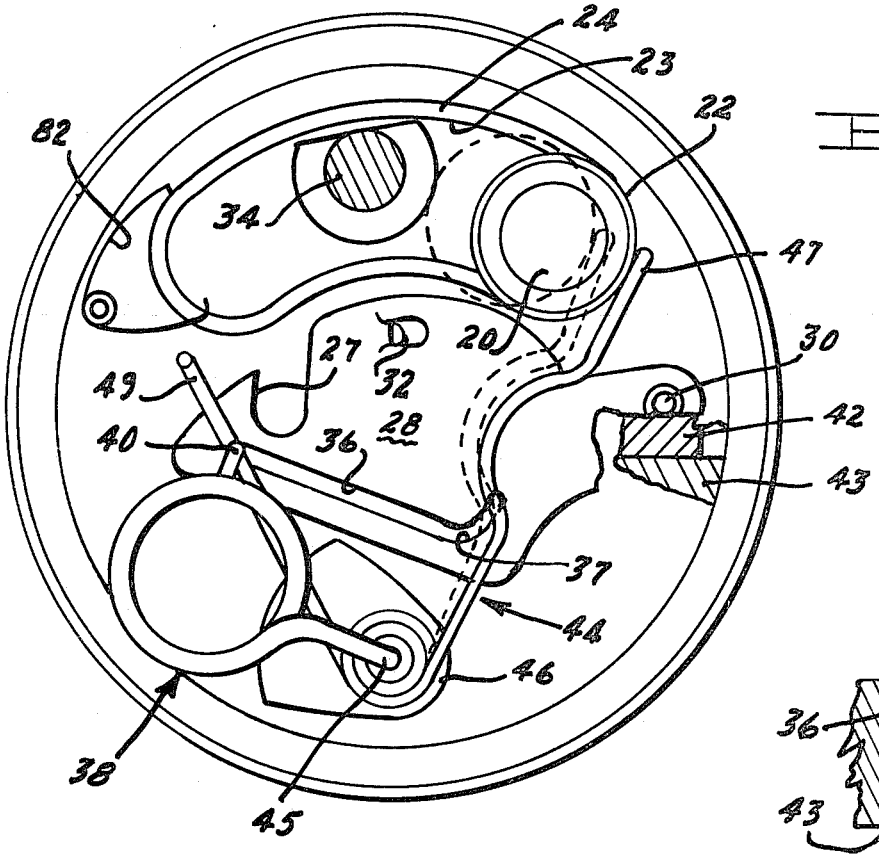
FIG. 6 is an enlarged plan view of the arming mechanism of the fuze of this invention in the partially armed position and shown partly in cross-section.

The cocking operation of fuze 10 is now described with particular reference to FIG. 6 of the drawing. In the initial phase of the cocking operation, fuze 10 is explosively safe, in that detonator 20 is prevented from movement out from the position shown in FIG. 2. As external pressure acts on piston 42 through opening 51, piston 42 moves inward against end 40 of cocking spring 38 which is attached thereto. As piston 42 moves, working end 40 of spring 38 is carried along slot 36 as a cam follower. Initially due to the off center relationship of piston 42 with respect to the working end 40 of spring 38, and because of the inward curvature at point 37 of slot 36, the movement of spring 38 causes a slight clockwise motion of lock plate 28. Thereafter lock plate 28 is fully moved about pivot point 30 in the counterclockwise direction until piston 42 bottoms. As shown in FIG. 6 the working end 40 of spring 38 also carries along with it end 49 of arming spring 44. With this movement arming spring 44 is thus loaded and the working end thereof 47 bears against slider assembly 22 with the arming preload and moves slider assembly 22 in the direction of wind tab pin 34 (shown in phantom in FIG. 6). As locking plate 28 rotates in the counterclockwise direction as shown in FIG. 6, it is withdrawn from wind tab pin 34 freeing the same. Wind tab pin 34 then withdraws a short distance due to bomblet packaging, but still solidly retains slider assembly 22 in the still safe but partially armed position abutting against pin 34. The firing mechanism 19 is completely unaffected by the cocking action just described since it is controlled solely by the presence of slider assembly 22 which is still in position abutting wind tab pin 34.

Figure 7:
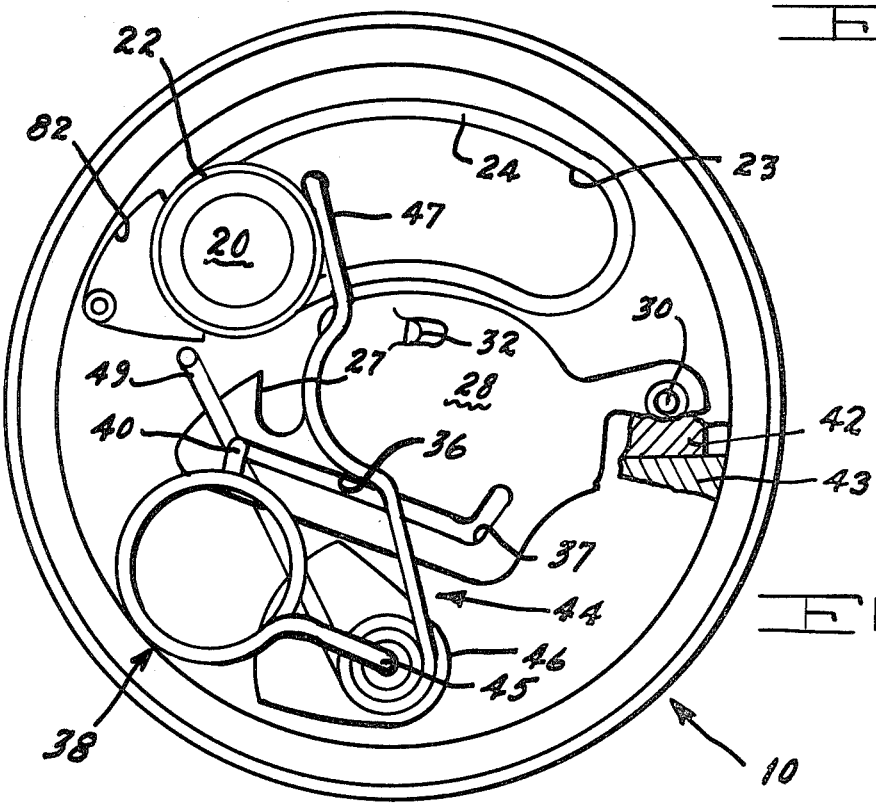
FIG. 7 is an enlarged plan view of the arming mechanism of the fuze of this invention in the armed position and shown partly in cross-section.

The arming of fuze 10 is accomplished by the functioning of wind tab 70 shown in FIG. 5 of the drawing. When wind tab pin 34 attached to wind tab 70 is retracted from housing 16 by means of aerodynamic forces acting thereupon upon the release of the fuzed munition, full retraction of wind tab pin 34 takes place. As shown in FIG. 7, slider assembly 22 is now free to move along curved channel 24 to the in-line position with firing pin 26 under the influence of arming spring 44. Slider assembly 22 in the fully armed position is aligned with firing pin 26 of firing mechanism 19 as well as with an output window 80 located in the bottom of lower body 14 and shown in FIG. 8. In this position slider assembly 22 is locked firmly in the armed position as shown in FIG. 7 by a conventional detent spring 82 secured to housing 16. Firing mechanism 19 (shown in FIG. 3) which was heretofore held safe by slider assembly 22 is now free of all restraint except that provided by lever spring 60 and sear ball 56 and is now readly to fire upon impact.

Fuze 10 of this invention is extremely rugged in construction even despite its small size. For example, the wind tab pin 34 could measure a full $\frac{1}{8}$ inch in diameter so that no inertia forces can shear this pin. It is in bearing in a close fit hole in upper body 12 for a full $1\frac{1}{2}$ diameters, and is therefore in no danger of tipping. Lock plate 28 could be constructed a full 0.020 inches thick and is in shear on two sides of groove 84. There again, no conceivable inertia forces could shear the plate 28 or fail the pin 34 in tension. Pin 34 protrudes from the top of fuze 10 only enough to be riveted into the wind tab 70 by rivet 71 and presents no opportunity for external objects to catch on the tab 70 or pin 34. If tampered with in a deliberate fashion by inserting a knife under the wind tab 70 and tension put on pin 34, pin 34 will first fail in tension at locking groove 33 but shear lock plate 28 last. Thus fuze 10 is essentially a tamper proof fuze.

In addition any premature actuation of firing pin 26 will dud fuze 10, in that it will never arm since firing pin 26 if tripped in the safe position, will enter cam slot 36 in lock plate 28, thus effectively locking fuze 10 in the safe position. Also, safety against shocks has been provided by the design of lock plate 28. The critical axis and direction are those directly along the axis of piston 42 and inward. Since lock plate 28 is well off this axis, the same deceleration or impact that tends to drive piston 42 inward also tends to rotate lock plate 28 in the counterclockwise direction. The hitch 37 in cam slot 36 causes the piston to attempt to rotate lock plate 28 clockwise initially. These forces are therefore in opposition.

The instant invention presents an extremely reliable and safe miniature fuze 10 for a "bomblet". As pointed out hereinabove this fuze 10 is safe for the following reasons:

(1) The cocking spring 38 is loaded toward the safe position and opposes arming;
(2) Failure of any component, including spring 38, cannot cause arming since the energy is not there; and
(3) It is necessary to introduce pressure energy greater than the opposition of spring 38 for the arming cycle to initiate.

Therefore, in the total picture, without the introduction of the pressure energy, arming cannot be caused until the criteria are met.

Fuze 10 is reliable since fuze 10 relies solely upon mechanical action within the fuze housing 16. There is no electrical activation within fuze 10 and all springs used therein can be easily pretested.

For a better understanding of the present invention together with other and further objects thereof reference is made to the following description taken in connection with the accompanying drawing and its scope will be pointed out in the appended claims.

I claim:

1. A fuze for use with a bomblet comprising a housing, an arming mechanism located within said housing, a firing mechanism located within said housing adjacent said arming mechanism, said arming mechanism being made up of a detonator moveable in only one plane, first means operatively associated with said detonator for preventing movement thereof when in a preselected position within said housing, said first movement prevention means being in the form of a plate pivotally mounted in said housing, said plate having an outstanding element thereon for engaging said detonator, second means operatively associated with said detonator for preventing movement thereof when in a preselected position within said housing, means having no pre-load thereon operatively connected to said detonator and capable of moving said detonator when in a loaded condition, means operatively connected to said detonator moving means for loading said detonator moving means, means operatively connected to said first means for removing said first means from its preselected position and means operatively connected to said second means for removing said second means from its preselected position, whereby upon the removal of said first and second means from said positions, said detonator moving means moves said detonator into a position in operable alignment with said firing mechanism thereby permitting the subsequent detonation of said fuze to take place.

2. A fuze for use with a bomblet comprisig a housing, an arming mechanism located within said housing, a firing mechanism located within said housing adjacent said arming mechanism, said arming mechanism being made up of a moveable detonator, first means operatively associated with said detonator for preventing movement thereof when in a preselected position within said housing, said first movement prevention means being in the form of a plate pivotally mounted in said housing, said plate having an outstanding element thereon for engaging said detonator and a cam slot therein, second means operatively associated with said detonator for preventing movement thereof when in a preselected position within said housing, means having no pre-load thereon operatively connected to said detonator and capable of moving said detonator when in a loaded condition, means operatively connected to said detonator moving means for loading said detonator moving means, said loading means being operatively connected to said slot within said plate, means operatively connected to said first means for removing said first means from its preselected position and means operatively connected to said second means for removing said second means from its preselected position, whereby upon the removal of said first and second means from said positions, said detonator moving means moves said detonator into a position in operable alignment with said firing mechanism thereby permitting the subsequent detonation of said fuze to take place.

3. A fuze for use with a bomblet as defined in claim 2 wherein said second movement prevention means comprises a pin, said plate operably engaging said pin to prevent removal thereof when in said preselected position.

4. A fuze for use with a bomblet as defined in claim 3 wherein said loading means is in the form of a spring having one end thereof mounted in said housing and said other end engaging said detonator moving means, passing through said cam slot in said plate and being operatively connected to said means for removing said plate from its preselected position.

5. A fuze for use with a bomblet as defined in claim 4 wherein said means having no pre-load thereon is in the form of a spring having an end thereof bearing against said detonator.

6. A fuze for use with a bomblet as defined in claim 5 wherein said firing mechanism comprises a firing spring having a firing pin at one end thereof in alignment with said detonator when said detonator is in said position capable of detonation.

7. A fuze for use with a bomblet as defined in claim 6 wherein said firing mechanism further comprises means operably connected to said firing spring to prevent movement thereof.

8. A fuze for use with a bomblet as defined in claim 7 wherein said means for removing said movement prevention pin from its preselected position comprises a wind tab.

* * * * *